US006521116B2

(12) United States Patent
Duruz et al.

(10) Patent No.: US 6,521,116 B2
(45) **Date of Patent: *Feb. 18, 2003**

(54) CELLS FOR THE ELECTROWINNING OF ALUMINIUM HAVING DIMENSIONALLY STABLE METAL-BASED ANODES

(75) Inventors: Jean-Jacques Duruz, Geneva (CH); Vittorio de Nora, Nassau (BS); Olivier Crottaz, Petit-Lancy (CH)

(73) Assignee: Moltech Invent S.A. (LU)

( * ) Notice: Subject to any disclaimer, the term of this patent is extended or adjusted under 35 U.S.C. 154(b) by 94 days.

This patent is subject to a terminal disclaimer.

(21) Appl. No.: 09/772,286

(22) Filed: Jan. 29, 2001

(65) Prior Publication Data

US 2001/0020590 A1 Sep. 13, 2001

Related U.S. Application Data

(63) Continuation of application No. PCT/IB99/01360, filed on Jul. 30, 1999.

(51) Int. Cl.[7] ..... C25C 3/08

(52) U.S. Cl. ..... 205/387; 205/372; 205/384; 205/385; 205/389; 205/392; 205/394; 204/243.1; 204/245; 204/247.3

(58) Field of Search ..... 204/243.1, 245, 204/247.3; 205/372, 384, 385, 387, 389, 392, 394

(56) References Cited

U.S. PATENT DOCUMENTS 6,372,099 B1 * 4/2002 Duruz et al. ..... 204/245

* cited by examiner

*Primary Examiner*—Bruce F. Bell
(74) *Attorney, Agent, or Firm*—Jayadeep R. Deshmukh

(57) ABSTRACT

A cell for the electrowinning of aluminium comprising one or more anodes (10), each having a metal-based anode substrate, for instance comprising a metal core (11) covered with an metal layer 12, an oxygen barrier layer (13), one or more intermediate layers (14; 14A, 14B) and an iron layer (15). The anode substrate is covered with an electrochemically active transition metal oxide layer, in particular an iron oxide-based outside layer (16) such as a hematite-based layer, which remains dimensionally stable during operation in a cell by maintaining in the electrolyte a sufficient concentration of iron species and dissolved alumina. The cell operating temperature is sufficiently low so species and dissolved alumina. The cell operating temperature is sufficiently low so that the required concentration of iron species in the electrolyte (5) is limited by the reduced solubility of iron species in the electrolyte at the operating temperature, which consequently limits the contamination of the product aluminium by iron to an acceptable level. The iron oxide-based layer (16) is usually an applied coating or an oxidised surface of a substrate (11, 12, 13, 14, 15), the surface (15) of which contains iron.

85 Claims, 1 Drawing Sheet

CELLS FOR THE ELECTROWINNING OF ALUMINIUM HAVING DIMENSIONALLY STABLE METAL-BASED ANODES

This application is a continuation of the US designation of PCT/IB99/01360 filed on Jul. 30, 1999.

FIELD OF THE INVENTION

This invention relates to cells for the electrowinning of aluminium by the electrolysis of alumina dissolved in a molten fluoride-containing electrolyte provided with dimensionally stable oxygen-evolving anodes, and to methods for the fabrication and reconditioning of such anodes, as well as to the operation of such cells to maintain the anodes dimensionally stable.

BACKGROUND ART

The technology for the production of aluminium by the electrolysis of alumina, dissolved in molten cryolite, at temperatures around 950° C. is more than one hundred years old.

This process, conceived almost simultaneously by Hall and Héroult, has not evolved as many other electrochemical processes.

The anodes are still made of carbonaceous material and must be replaced every few weeks. During electrolysis the oxygen which should evolve on the anode surface combines with the carbon to form polluting $CO_2$ and small amounts of CO and fluorine-containing dangerous gases. The actual consumption of the anode is as much as 450 Kg/Ton of aluminium produced which is more than ⅓ higher than the theoretical amount of 333 Kg/Ton.

Metal or metal-based anodes are highly desirable in aluminium electrowinning cells instead of carbon-based anodes. As mentioned hereabove, many attempts were made to use metallic anodes for aluminium production, however they were never adopted by the aluminium industry.

EP Patent application 0 306 100 (Nyguen/Lazouni/Doan) describes anodes composed of a chromium, nickel, cobalt and/or iron based substrate covered with an oxygen barrier layer and a ceramic coating of nickel, copper and/or manganese oxide which may be further covered with an in-situ formed protective cerium oxyfluoride layer.

Likewise, U.S. Pat. Nos. 5,069,771, 4,960,494 and 4,956,068 (all Nyguen/Lazouni/Doan) disclose aluminium production anodes with an oxidised copper-nickel surface on an alloy substrate with a protective barrier layer. However, full protection of the alloy substrate was difficult to achieve.

U.S. Pat. No. 4,999,097 (Sadoway) describes anodes for conventional aluminium electrowinning cells provided with an oxide coating containing at least one oxide of zirconium, hafnium, thorium and uranium. To prevent consumption of the anode, the bath is saturated with the materials that form the coating. However, these coatings are poorly conductive and have not found commercial acceptance.

U.S. Pat. No. 4,504,369 (Keller) discloses a method for producing aluminium in a conventional cell using anodes whose dissolution into the electrolytic bath is reduced by adding anode constituent materials into the electrolyte, allowing slow dissolution of the anode. However, this method is impractical because it would lead to a contamination of the product aluminium by the anode constituent materials which is considerably above the acceptable level in industrial production. To limit contamination of the product aluminium, it was suggested to reduce the reduction rate of the dissolved constituent materials at the cathode, by limiting the cathode surface area or by reducing mass transfer rates by other means. However, the feasibility of these proposals has never been demonstrated, nor was it contemplated that the amount of the anode constituent materials dissolved in the electrolyte should be reduced.

U.S. Pat. No. 4,614,569 (Duruz/Derivaz/Debely/Adorian) describes metal anodes for aluminium electrowinning coated with a protective coating of cerium oxyfluoride, formed in-situ in the cell or pre-applied, this coating being maintained by the addition of small amounts of cerium to the molten cryolite electrolyte so as to protect the surface of the anode from the electrolyte attack. All other attempts to reduce the anode wear by slowing dissolution of the anode with an adequate concentration of its constituents in the molten electrolyte, for example as described in U.S. Pat. Nos. 4,999,097 (Sadoway) and 4,504,369 (Keller), have failed.

In known processes, even the least soluble anode material releases excessive amounts constituents into the bath, which leads to an excessive contamination of the product aluminium. For example, the concentration of nickel (a frequent component of stable anodes) found in aluminium produced in laboratory tests at conventional cell operating temperatures is typically comprised between 800 and 2000 ppm, i.e. 4 to 10 times the acceptable level which is 200 ppm.

The extensive research which was carried out to develop suitable metal anodes having limited dissolution did not find any commercial acceptance because of the excessive contamination of the product aluminium by the anode materials.

OBJECTS OF THE INVENTION

A major object of the invention is to provide an anode for aluminium electrowinning which has no carbon so as to eliminate carbon-generated pollution and increase the anode life.

A further object of the invention is to provide an aluminium electrowinning anode material with a surface having a high electrochemical activity for the oxidation of oxygen ions for the formation of bimolecular gaseous oxygen and a low solubility in the electrolyte.

An important object of the invention is to reduce the solubility of the surface layer of an aluminium electrowinning anode, thereby maintaining the anode dimensionally stable without excessively contaminating the product aluminium.

Another object of the invention is to provide operating conditions for an aluminium electrowinning cell under which conditions the contamination of the product aluminium is limited.

A subsidiary object of the invention is to provide a cell for the electrowinning of aluminium whose side walls are resistant to electrolyte, thereby allowing operation of the cell without formation of a frozen electrolyte layer on the side walls and with reduced thermal loss.

SUMMARY OF THE INVENTION

The invention relates to dimensional stabilisation of oxygen-evolving anodes of cells for the electrowinning of aluminium by the electrolysis of alumina dissolved in a molten fluoride-containing electrolyte. It has been found that dissolution of anodes comprising a transition metal-based oxide surface, in particular an electrochemically active outside layer of iron oxide, cobalt oxide, nickel oxide or combination thereof, can be kept dimensionally stable during electrolysis by maintaining in the electrolyte a sufficient concentration of dissolved alumina and transition metal species which are present as one or more corresponding transition metal oxides in the anode surface, and operating the cell at a sufficiently low temperature so that the required concentration of the transition metal species in the electrolyte is limited by the reduced solubility thereof in the electrolyte at the operating temperature, which consequently limits to an acceptable level the contamination of the product aluminium by the transition metals which are present as one or more corresponding transition metal oxides in said outside layer.

The invention is particularly but not exclusively concerned with iron oxide-containing electrochemically active anode surfaces and will be further described and illustrated with particular reference thereto.

It has been observed that iron oxides and in particular hematite ($Fe_2O_3$) have a higher solubility than nickel in molten electrolyte. However, in industrial production the contamination tolerance of the product aluminium by iron oxides is also much higher (up to 2000 ppm) than for other metal impurities.

Solubility is an intrinsic property of anode materials and cannot be changed otherwise than by modifying the electrolyte composition and/or the operating temperature of a cell.

Laboratory scale cell tests utilising a $NiFe_2O_4$/Cu cermet anode and operating under steady conditions were carried out to establish the concentration of iron in molten electrolyte and in the product aluminium under different operating conditions.

In the case of iron oxide, it has been found that lowering the temperature of the electrolyte decreases considerably the solubility of iron species. This effect can surprisingly be exploited to produce a major impact on cell operation by limiting the contamination of the product aluminium by iron.

The solubility of iron species in the electrolyte can even be further reduced by keeping therein a sufficient concentration of dissolved alumina, i.e. by maintaining the electrolyte as close as possible to saturation with alumina. Maintaining a high concentration of dissolved alumina in the molten electrolyte decreases the solubility limit of iron species and consequently the contamination of the product aluminium by cathodically reduced iron.

Thus, it has been found that when the operating temperature of aluminium electrowinning cells is reduced below the temperature of conventional cells an anode coated with an outer layer of iron oxide can be made dimensionally stable by maintaining a concentration of iron species and alumina, in the molten electrolyte sufficient to suppress the dissolution of the anode coating but low enough not to exceed the commercially acceptable level of iron in the product aluminium.

CELLS AND OPERATION

The invention provides a cell for the electrowinning of aluminium by the electrolysis of alumina dissolved in a molten fluoride-containing electrolyte. The cell comprises one or more anodes, each having a metal-based substrate and an electrochemically-active iron oxide-based outside layer, in particular a hematite-based layer, which remains dimensionally stable by maintaining in the electrolyte a sufficient concentration of iron species and alumina. The cell operating temperature is sufficiently low so that the required concentration of iron species in the electrolyte is limited by the reduced solubility of iron species in the electrolyte at the operating temperature, which consequently limits the contamination of the product aluminium by iron to an acceptable level.

In the context of this invention:

- a metal-based anode means that the anode contains at least one metal in the anode substrate as such or as an alloy, intermetallic and/or cermet.
- an iron oxide-based layer means that the layer contains predominately iron oxide, as a simple oxide such as hematite, or as part of an electrically conductive and electrochemically active double or multiple oxide, such as a ferrite, in particular cobalt, manganese, nickel, magnesium or zinc ferrite.

More generally, the iron-oxide may be present in the electrochemically active layer as such, in a multi-compound mixed oxide, in mixed crystals and/or in a solid solution of oxides, in the form of a stoichiometric or non-stoichiometric oxide.

The solubility of iron species in the electrolyte may be influenced by the presence in the electrolyte of species other than iron, such as aluminium, calcium, lithium, magnesium, nickel, sodium, potassium and/or barium species.

Usually, the iron oxide-based outside layer of the anode is either an applied layer or obtainable by oxidising the surface of the anode substrate which contains iron as further described below.

The cell is usually operated with an operating temperature of the electrolyte below 910° C. The operating temperature of the electrolyte is usually above 700° C., and preferably between 820° C. and 870° C.

The electrolyte may contain NaF and $AlF_3$ in a weight ratio $NaF/AlF_3$ from about 0.74 to 0.82. The concentration of alumina dissolved in the electrolyte is usually below 8 weight %, usually between 2 weight % and 6 weight %.

In order for the produced aluminium to be commercially acceptable, the amount of dissolved iron in the electrolyte which prevents dissolution of the iron oxide-based anode layer is such that the product aluminium is contaminated by no more than 2000 ppm iron, preferably by no more than 1000 ppm iron, and if required by no more than 500 ppm iron.

The cell may comprise means for periodically or intermittently feeding iron species into the electrolyte to maintain the required amount of iron species in the electrolyte at the operating temperature which prevents the dissolution of the iron oxide-based anode layer. The means for feeding iron species may feed iron metal and/or an iron compound, such as iron oxide, iron fluoride, iron oxyfluoride and/or an iron-aluminium alloy.

The means for feeding iron species may periodically feed iron species together with alumina into the electrolyte. Alternatively, the means for feeding iron species may be a sacrificial electrode continuously feeding iron species into the electrolyte.

The dissolution of such a sacrificial electrode may be controlled and/or promoted by applying a voltage thereto which is lower than the voltage of oxidation of oxygen ions. The voltage applied to the sacrificial electrode may be adjusted so that the resulting current passing through the sacrificial electrode corresponds to a current necessary for the dissolution of the required amount of iron species into the electrolyte replacing the iron which is cathodically reduced and not otherwise compensated.

Advantageously, the cell may comprise an aluminium-wettable cathode which can be a drained cathode on which aluminium is produced and from which it continuously drains, as described in U.S. Pat. Nos. 5,651,874 (de Nora/Sekhar) and 5,683,559 (de Nora).

Usually, the cell is in a monopolar, multi-monopolar or in a bipolar configuration. Bipolar cells may comprise the anodes as described above as the anodic side of at least one bipolar electrode and/or as a terminal anode.

Preferably, the cell comprises means to improve the circulation of the electrolyte between the anodes and facing cathodes and/or means to facilitate dissolution of alumina in the electrolyte. Such means can for instance be provided by the geometry of the cell as described in co-pending application PCT/IB99/00222 (de Nora/Duruz) or by periodically moving the anodes as described in co-pending application PCT/IB99/00223 (Duruz/Bellò).

The cell according to the invention may also have side walls provided with an iron oxide-based outside layer which is during cell operation in contact only with the electrolyte and which is maintained dimensionally stable by the amount of iron species and alumina dissolved in the electrolyte. The iron oxide-based layer on the side walls may be in contact with molten electrolyte. By maintaining the side walls free from frozen electrolyte, the cell may be operated with reduced thermal loss.

The invention relates also to a method of producing aluminium in a cell as described hereabove. The method comprises keeping the anode dimensionally stable during electrolysis by maintaining a sufficient concentration of iron species and alumina in the electrolyte, and operating the cell at a sufficiently low temperature so that the required concentration of iron species in the electrolyte is limited by the reduced solubility of iron species in the electrolyte at the operating temperature, which consequently limits the contamination of the product aluminium by iron to an acceptable level.

CELL COMPONENTS AND METHODS OF FABRICATION

Another aspect of the invention is an anode which can be maintained dimensionally stable in a cell as described above. The anode has a metal-based substrate comprising at least one metal, an alloy, an intermetallic compound or a cermet. The substrate is covered with an iron oxide-based outside layer, in particular a hematite-based layer, which is electrochemically active for the oxidation of oxygen ions into molecular oxygen.

As already stated above, the iron oxide-based outside layer of the anode is usually either an applied layer or obtainable by oxidising the surface of the anode substrate which contains iron.

The iron oxide-based layer may be formed chemically or electrochemically and optionally in-situ on the anode substrate.

Alternatively, the iron oxide-based layer may be applied as a colloidal and/or polymeric slurry, and dried and/or heat treated. The colloidal and/or polymeric slurry may comprise at least one of alumina, ceria, lithia, magnesia, silica, thoria, yttria, zirconia, tin oxide and zinc oxide.

The iron oxide-based layer may also be formed by arc or plasma spraying iron oxide or iron onto the anode substrate followed by an oxidation treatment.

The iron oxide-based layer may be formed, or consolidated, by heat treating an anode substrate, the surface of which contains iron and/or iron oxide, in an oxidising gas at a temperature above the operating temperature of a cell in which the anode is to be inserted.

Usually, the anode substrate is heat treated in air or in oxygen at a temperature of 950° C. to 1250° C. for a period of time depending on the temperature.

The iron oxide-based layer can comprise a dense iron oxide outer portion, a microporous intermediate iron oxide portion and an inner portion containing iron oxide and a metal from the surface of the anode substrate.

The anode substrate may comprise a plurality of layers carrying the iron oxide-based layer. For instance, the anode substrate may be made by forming on a core layer an oxygen barrier layer which is coated with at least one intermediate layer carrying the iron oxide-based layer, the oxygen barrier layer being formed before or after application of the intermediate layer(s).

The oxygen barrier layer may be formed by applying a coating onto the core layer before application of the intermediate layer(s) or by surface oxidation of the core layer before or after application of the intermediate layer(s).

The oxygen barrier layer and/or the intermediate layer may be formed by slurry application of a precursor. Alternatively, the oxygen barrier layer and/or the intermediate layer may be formed by arc or plasma spraying oxides thereof, or by arc or plasma spraying metals and forming the oxides by heat treatment.

Usually, the oxygen barrier layer contains at least one oxide selected from chromium, niobium and nickel oxide, and is covered with an intermediate layer containing copper, or copper and nickel, and/or their oxides.

A preferred embodiment of the anode is a composite, high-temperature resistant, non-carbon, metal-based anode having a metal-based core structure of low electrical resistance for connecting the anode to a positive current supply and coated with a series of superimposed, adherent, electrically conductive layers consisting of:

a) at least one layer on the metal-based core structure forming a barrier substantially impervious to molecular oxygen and also to monoatomic oxygen;

b) one or more intermediate layers on the outermost oxygen barrier layer to protect the oxygen barrier and which remain inactive in the reactions for the evolution of oxygen gas and inhibit the dissolution of the oxygen barrier; and c) an electrochemically-active iron oxide-based outside layer, in particular a hematite-based layer, on the outermost intermediate layer, for the oxidation reaction of oxygen ions present at the anode/electrolyte interface into monoatomic oxygen, as well as for subsequent reaction for the formation of biatomic molecular oxygen evolving as gas.

In some embodiments, the iron oxide layer is coated onto a passivatable and inert anode substrate.

Different types of anode substrate may be used to carry an applied iron oxide-based layer. Usually, the anode substrate comprises at least one metal, an alloy, an intermetallic compound or a cermet.

The anode substrate may for instance comprise at least one of nickel, copper, cobalt, chromium, molybdenum, tantalum, iron, and their alloys or intermetallic compounds, and combinations thereof. For instance, the anode substrate may comprise an alloy consisting of 10 to 30 weight % of chromium, 55 to 90% of at least one of nickel, cobalt or iron, and 0 to 15% of aluminium, titanium, zirconium, yttrium, hafnium or niobium.

Alternatively, some iron-containing anode substrates are suitable for carrying an iron oxide-based layer which is either applied onto the surface of the anode substrate or obtained by oxidation of the surface of the substrate. The anode substrate may for instance contain an alloy of iron and at least one alloying metal selected from nickel, cobalt, molybdenum, tantalum, niobium, titanium, zirconium, manganese and copper, in particular between 50 and 80 weight% iron and between 20 and 50 weight % nickel, preferably between 60 and 70 weight % iron and between 30 and 40 weight % nickel.

Another aspect of the invention is a bipolar electrode which comprises on its anodic side an anode as described above and which can be maintained dimensionally stable during operation in a bipolar cell.

These anode materials may also be used to manufacture cell sidewalls which can be maintained dimensionally stable during operation of the cell as described above.

A further aspect of the invention is a cell component which can be maintained dimensionally stable in a cell as described above, having an iron oxide-based outside layer, in particular a hematite-based layer, which is electrochemically active for the oxidation of oxygen ions into molecular oxygen. The hematite-based layer may cover a metal-based anode substrate comprising at least one metal, an alloy, an intermetallic compound or a cermet.

Yet another aspect of the invention is a method of manufacturing an anode of a cell as described above. The method comprises forming an iron oxide-based outside layer on a metal-based anode substrate made of at least one metal, an alloy, an intermetallic compound or a cermet either by oxidising the surface of the anode substrate which contains iron, or by coating the iron oxide-based layer onto the substrate.

This method may also be used for reconditioning an anode as described above, whose iron oxide-based layer is damaged. The method comprises clearing at least the damaged parts of the iron oxide-based layer from the anode substrate and then reconstituting at least the iron oxide-based layer.

VARIATION OF THE INVENTION

Generally, the teachings and principles disclosed hereabove relating to anodes, cells and cell operation are also applicable to any anode whose electrochemically active layer comprises an oxidised transition metal, such as an oxidised nickel-cobalt alloy, as described at the outset of the summary of the invention.

In particular, nickel-cobalt active anode surfaces may also be kept dimensionally stable by maintaining a sufficient amount of dissolved alumina and nickel and/or cobalt species in the electrolyte.

Whereas nickel as well as cobalt on their own are poor candidates as electrochemically active materials for aluminium electrowinning cells, an alloy of nickel and cobalt shows the following properties.

A nickel-cobalt alloy forms upon oxidation complex oxides, in particular $(Ni_xCo_{1-x})O$, having semi-conducting properties.

Furthermore, nickel-cobalt oxides provide an advantage over conventional nickel ferrite. Whereas trivalent iron ions of nickel ferrite are slowly replaced by trivalent aluminium ions in the octahedral sites of the spinel lattice, which leads to a loss of conductivity and of mechanical stability, nickel-cobalt alloys oxidised in oxygen at 1000° C. lead to a semi-conducting mixed oxide structure of $NiCo_2O_4$ and $CO_3O_4$ spinels which is similar to the NaCl lattice. In these spinels, a replacement of trivalent cobalt ions by trivalent aluminium ions is unlikely.

In order to form an electrochemically active layer suitable for aluminium electrowinning anodes, the cobalt nickel atomic ratio is preferably chosen in the range of 2 to 2.7.

BRIEF DESCRIPTION OF THE DRAWINGS

The invention will now be described by way of example with reference to the accompanying schematic drawings, in which.

DETAILED DESCRIPTION

Figure 1:
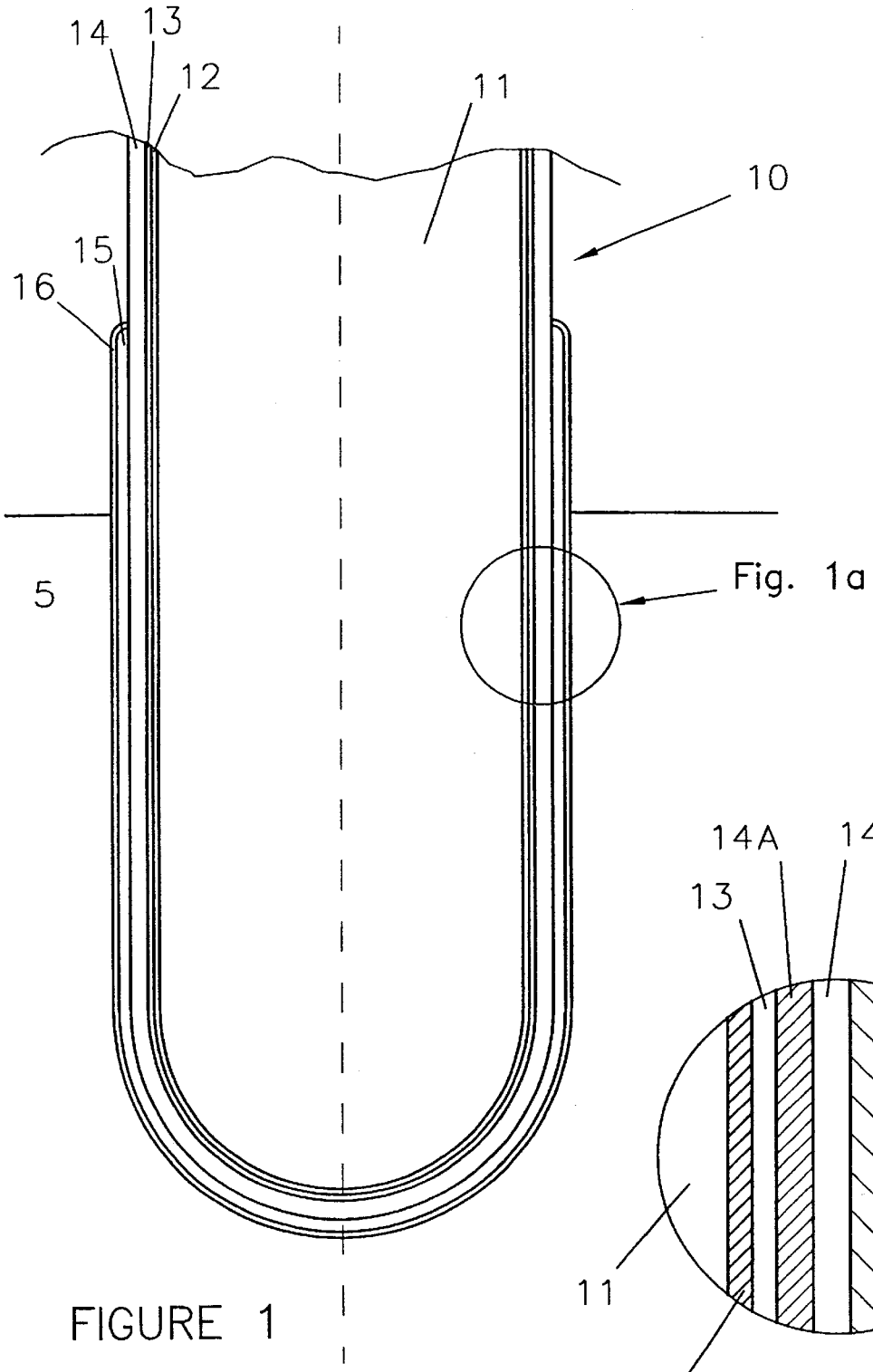
FIG. 1 is a cross-sectional view through an anode made of an anode substrate comprising a plurality of layers and carrying on the outermost layer the iron oxide-based layer.

FIG. 1 shows an anode 10 according to the invention which is immersed in an electrolyte 5. The anode 10 contains a layered substrate comprising a core 11 which may be copper, an intermediate layer 12, such as electrodeposited nickel, covering the core 11, to provide an anchorage for an oxygen barrier layer 13. The oxygen barrier 13 may be applied by electrodepositing a metal such as chromium, niobium and/or nickel and heat treating in an oxidising media to form chromium oxide, niobium oxide and/or nickel oxide.

On the oxygen barrier layer 13 there is a protective intermediate layer 14 which can be obtained by electrodepositing, arc spraying or plasma spraying and then oxidising either a nickel-copper alloy layer, or a nickel layer and a copper layer and interdiffusing the applied nickel and copper layers before oxidation. The protective intermediate layer 14 protects the oxygen barrier layer 13 by inhibiting its dissolution.

The protective intermediate layer 14 is covered with an electrodeposited, arc-sprayed or plasma-sprayed iron layer 15 which is surface oxidised to form an electrochemically active hematite-based surface layer 16, forming the outer surface of the anode 10 according to the invention.

In FIG. 1, the iron layer 15 and the electrochemically active hematite-based surface layer 16 cover the substrate of the anode 10 where exposed to the electrolyte 5. However the iron layer 15 and the hematite-based layer 16 may extend far above the surface of the electrolyte 5, up to the connection with a positive current bus bar.

Figure 1A:
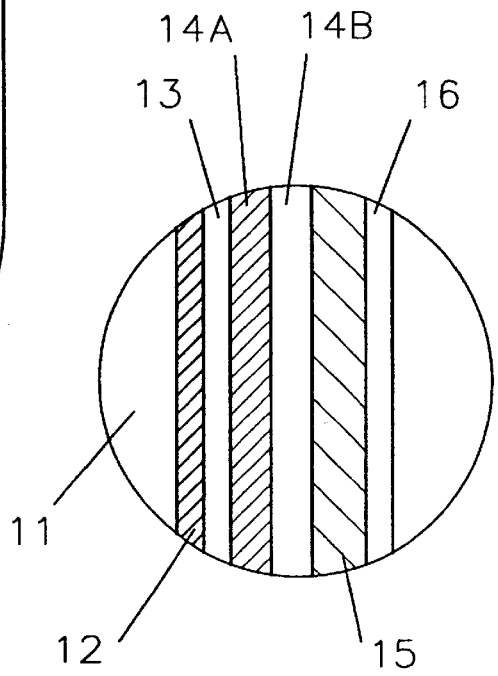
FIG. 1*a* is a magnified view of a modification of the applied layers of the anode of FIG. 1.

FIG. 1*a* shows a magnified view of a modification of the applied layers of the anode 10 of FIG. 1. Instead of a single intermediate layer 14 shown in FIG. 1, the anode 10 as shown in FIG. 1*a* comprises two distinct intermediate protective layers 14A,14B.

Similarly to the anode 10 of FIG. 1, the anode 10 of FIG. 1*a* comprises a core 11 which may be copper covered with a nickel plated layer 12 forming an anchorage for a chromium oxide oxygen barrier layer 13. However, the single oxidised interdiffused or alloyed nickel copper layer 14 shown in FIG. 1 is modified in FIG. 1*a* by firstly applying on the oxygen barrier 13 a nickel layer 14A followed by a copper layer 14B. The nickel and copper layers 14A,14B are oxidised at 1000° C. in air without prior interdiffusion by a heat treatment in an inert atmosphere, thereby converting these layers into a nickel oxide rich layer 14A and a copper oxide rich layer 14B. The nickel oxide rich layer 14A and the copper oxide rich layer 14B may interdiffuse during use in the cell.

The intermediate layers 14;14A,14B may either be oxidised before use of the anode 10, before or after application of an iron layer 15, or during normal electrolysis in a cell.

The intermediate layers 14A,14B of the anode 10 of FIG. 1*a* are covered with an electrodeposited, arc-sprayed or plasma-sprayed iron layer 15 which is surface oxidised to form an electrochemically active hematite-based surface layer 16, forming the outer surface of the anode 10 according to the invention.

The invention will be further described in the following Examples:

EXAMPLE 1

Aluminium was produced in a laboratory scale cell comprising an anode according to the invention.

The anode was made by pre-oxidising in air at about 1100° C. for 10 hours a substrate of a nickel-iron alloy consisting of 30 weight % nickel and 70 weight % iron, thereby forming a dense hematite-based surface layer on the alloy.

The anode was then tested at a current density of about 0.8 $A/cm^2$ in a fluoride-containing molten electrolyte at 850° C. containing NaF and $AlF_3$ in a weight ratio $NaF/AlF_3$ of 0.8 and approximately 4 weight % alumina. Furthermore, the electrolyte contained approximately 180 ppm iron species obtained from the dissolution of iron oxide thereby saturating the electrolyte with iron species and inhibiting dissolution of the hematite-based anode surface layer.

To maintain the concentration of dissolved alumina in the electrolyte, fresh alumina was periodically fed into the cell. The alumina feed contained sufficient iron oxide so as to replace the iron which had deposited into the product aluminium, thereby maintaining the concentration of iron in the electrolyte at the limit of solubility and preventing dissolution of the hematite-based anode surface layer.

The anode was extracted from the electrolyte after 100 hours and showed no sign of significant internal or external corrosion after microscopic examination of a cross-section of the anode specimen.

The produced aluminium was also analysed and showed an iron contamination of about 800 ppm which is below the tolerated iron contamination in commercial aluminium production.

EXAMPLE 2

An anode was made by coating by electro-deposition a structure in the form of a rod having a diameter of 12 mm consisting of 74 weight % nickel, 17 weight % chromium and 9 weight % iron, such as Inconel®, first with a nickel layer about 200 micron thick and then a copper layer about 100 micron thick.

The coated structure was heat treated at 1000° C. in argon for 5 hours. This heat treatment provides for the interdiffusion of nickel and copper to form an intermediate layer. The structure was then heat treated for 24 hours at 1000° C. in air to form an oxygen barrier layer of chromium oxide on the core structure and oxidising at least partly the interdiffused nickel-copper layer thereby forming the intermediate layer.

A further layer of a nickel-iron alloy consisting of 30 weight % nickel and 70 weight % having a thickness of about 0.5 mm was then applied on the interdiffused nickel copper layer by arc or plasma spraying.

The alloy layer was then pre-oxidised at 1100° C. for 6 hours to form a chromium oxide barrier layer on the Inconel® structure and a dense hematite-based outer surface layer on the alloy layer.

The anode was then tested in molten electrolyte containing approximately 4 weight % alumina at 850° C. at a current density of about 0.8 $A/cm^2$. The anode was extracted from the cryolite after 100 hours and showed no sign of significant internal or external corrosion after microscopic examination of a cross-section of the anode sample.

As a variation, the Inconel® core structure can be replaced by a nickel-plated copper body which is coated with a chromium layer and oxidised to form a chromium oxide oxygen barrier which can be covered as described above with an interdiffused nickel-copper intermediate layer and the electrochemically active hematite-based outer layer.

What is claimed is:

1. A cell for the electrowinning of aluminium by the electrolysis of alumina dissolved in a molten flouride-containing electrolyte, comprising one or more anodes, each having a metal-based substrate and an electrochemically-active iron oxide-based outside layer, which remains dimensionally stable by maintaining in the electrolyte a sufficient concentration of iron species and dissolved alumina, the cell operating temperature being sufficiently low so that the required concentration of iron species in the electrolyte is limited by the reduced solubility of iron species in the electrolyte at the operating temperature, which consequently limits the contamination of the product aluminium by iron to an acceptable level.

2. The cell of claim 1, wherein the iron oxide-based outside layer is either an applied layer or obtainable by oxidising the surface of the anode substrate which contains iron.

3. The cell of claim 2, wherein the anode substrate comprises a plurality of layers carrying the iron oxide-based layer.

4. The cell of claim 3, wherein the anode substrate comprises an electrically conductive core layer covered with an oxygen barrier layer coated with at least one intermediate layer carrying the iron oxide-based layer.

5. The cell of claim 4, wherein the oxygen barrier layer contains at least one oxide selected from chromium, niobium and nickel oxide.

6. The cell of claim 4, wherein the intermediate layer contains copper, or copper and nickel, and/or their oxides.

7. The cell of claim 1, wherein the anode substrate comprises at least one metal, an alloy, an intermetallic compound or a cermet.

8. The cell of claim 7, wherein the anode substrate comprises at least one of nickel, copper, cobalt, chromium, molybdenum, tantalum, iron, and their alloys or intermetallic compounds, and combinations thereof.

9. The cell of claim 8, wherein the anode substrate comprises an alloy consisting of 10 to 30 weight % of chromium, 55 to 90% of at least one of nickel, cobalt or iron, and 0 to 15% of aluminium, titanium, zirconium, yttrium, hafnium or niobium.

10. The cell of claim 8, wherein the anode substrate contains an alloy of iron and at least one alloying metal selected from nickel, cobalt, molybdenum, tantalum, niobium, titanium, zirconium, manganese and copper.

11. The cell of claim 10, wherein the substrate alloy comprises 30 to 70 weight % iron and 30 to 70 weight % nickel.

12. The cell of claim 10, wherein the substrate alloy comprises an alloy of iron and cobalt.

13. The cell of claim 1, wherein the operating temperature of the electrolyte is above 700° C.

14. The cell of claim 13, wherein the operating temperature ranges from between 820° C. and 870° C.

15. The cell of claim 1, wherein the electrolyte contains NaF and $AlF_3$ in a weight ratio $NaF/AlF_3$ from 0.7 to 0.85.

16. The cell of claim 1, wherein the concentration of alumina dissolved in the electrolyte is below 8 weight %.

17. The cell of claim 16, wherein the concentration of alumina is between 2 and 6 weight %.

18. The cell of claim 1, comprising means for intermittently or continuously feeding iron species into the electrolyte to maintain an amount of iron species in the electrolyte preventing the dissolution of the iron oxide-based anode layer.

19. The cell of claim 18, wherein the means for feeding iron species feeds iron metal and/or an iron compound.

20. The cell of claim 19, wherein the means for feeding iron species feeds iron oxide, iron fluoride, iron oxyfluoride and/or an iron-aluminium alloy.

21. The cell of claim 18, wherein the means for feeding iron species is arranged to periodically feed the iron species together with alumina into the electrolyte.

22. The cell of claim 18, wherein the means for feeding iron species is a sacrificial electrode continuously feeding the iron species into the electrolyte.

23. The cell of claim 22, wherein the sacrificial electrode is connected to a current supply arranged to apply a voltage which is lower than the voltage of oxidation of oxygen $O^-$and supply a current controlling and/or promoting the dissolution of the sacrificial electrode into the electrolyte.

24. The cell of claim 1, comprising an aluminium-wettable cathode.

25. The cell of claim 24, comprising a drained cathode.

26. The cell of claim 1, which is in a bipolar configuration.

27. The cell of claim 1, comprising means to improve the circulation of the electrolyte between the anodes and facing cathodes and/or means to facilitate dissolution of alumina in the electrolyte.

28. An anode which is maintained dimensionally stable in a cell for the electrowinning of aluminium according to claim 1, having a metal-based substrate comprising at least one metal, an alloy, an intermetallic compound or a cermet, the substrate being covered with an iron oxide-based outside layer, which is electrochemically active for the oxidation of oxygen ions into molecular oxygen.

29. The anode of claim 28, wherein the iron oxide-based outside layer is either an applied layer or obtainable by oxidising the surface of the anode substrate which contains iron.

30. The anode of claim 29, wherein the iron oxide-based layer comprises a dense iron oxide outer portion, a microporous intermediate iron oxide portion and an inner portion containing iron oxide and a metal from the surface of the anode substrate.

31. The anode of claim 29, wherein the anode substrate comprises a plurality of layers carrying the iron oxide-based layer.

32. The anode of claim 31, wherein the anode substrate comprises an electrically conductive core layer covered with an oxygen barrier layer coated with at least one intermediate layer carrying the iron oxide-based layer.

33. The anode of claim 32, wherein the oxygen barrier layer contains at least one oxide selected from chromium, niobium and nickel oxide.

34. The anode of claim 32, wherein the intermediate layer contains copper, or copper and nickel, and/or their oxides.

35. The anode of claims 28, wherein the anode substrate comprises at least one of nickel, copper, cobalt, chromium, molybdenum, tantalum, iron, and their alloys or intermetallic compounds, and combinations thereof.

36. The anode of claim 35, wherein the anode substrate comprises an alloy consisting of 10 to 30 weight % of chromium, 55 to 90% of at least one of nickel, cobalt or iron, and 0 to 15% of aluminium, titanium, zirconium, yttrium, hafnium or niobium.

37. The anode of claim 35, wherein the anode substrate contains an alloy of iron and at least one alloying metal selected from nickel, copper, cobalt, chromium, molybdenum, tantalum, iron, and their alloys or intermetallic compounds, and combinations thereof.

38. The anode of claim 35, wherein the alloy substrate comprises 30 to 70 weight % iron and 30 to 70 weight % nickel.

39. The anode of claim 35, wherein the substrate alloy comprises an alloy of iron and cobalt.

40. A bipolar electrode which comprises on its anodic side an anode according to claim 28.

41. The anode of claim 28, wherein the oxide-based layer is a hematite-based layer.

42. A method of manufacturing an anode according to claim 28, said method comprising forming an iron oxide-based outside layer, on a metal-based anode substrate made of at least one metal, an alloy, an intermetallic compound or a cermet either by oxidising the anode surface of the substrate which contains iron, or by coating the iron oxide-based layer onto the substrate.

43. The method of claim 42, wherein the iron oxide-based layer is formed chemically or electrochemically on the anode substrate.

44. The method of claim 42, wherein the iron oxide-based layer is applied as a colloidal and/or polymeric slurry, and dried and/or heat treated.

45. The method of claim 44, wherein the colloidal and/or polymeric slurry comprises at least one of alumina, ceria, lithia, magnesia, silica, thoria, yttria, zirconia, tin oxide and zinc oxide.

46. The method of claim 42, wherein the iron oxide-based layer is formed by arc or plasma spraying iron oxide or iron onto the anode substrate followed by an oxidation treatment.

47. The method of claim 46, wherein the anode substrate is heat treated in air or in oxygen.

48. The method of claim 42, wherein the iron oxide-based layer is formed, or consolidated, by heat treating an anode substrate, the surface of which contains iron and/or iron oxide, in an oxidising gas at a temperature above the operating temperature of the cell in which the anode is to be inserted.

49. The method of claim 48, wherein the anode substrate is heat treated at a temperature of 950° C. to 1250° C.

50. The method of claim 42, wherein the iron oxide-based layer is formed on an anode substrate comprising a plurality of layers.

51. The method of claim 50, wherein the anode substrate is made by forming on a core layer an oxygen barrier layer which is coated with at least one intermediate layer and the iron oxide-based outside layer, said oxygen barrier layer being formed before or after application of the intermediate layer(s).

52. The method of claim 51, wherein the oxygen barrier layer is formed by applying a coating onto the core layer before application of the intermediate layer(s) or by surface oxidation of the core layer before or after application of the intermediate layer(s).

53. The method of claim 52, wherein the oxygen barrier layer and/or the intermediate layer is/are formed by slurry application of a precursor.

54. The method of claim 52, wherein the oxygen barrier layer and/or the intermediate layer is/are formed by arc or plasma spraying oxides thereof, or by arc or plasma spraying metals and forming the oxides by heat treatment.

55. A method for reconditioning the anode according to claim 28 whose iron oxide-based layer is damaged, the method comprising clearing at least the damaged parts of the iron oxide-based layer from the anode substrate and then reconstituting at least the iron oxide-based layer.

56. The method of claim 42, wherein the oxide-based layer is a hematite-based layer.

57. A method of producing aluminum in a cell according to claim 1, the cell comprising an anode having a metal-based anode substrate and an iron oxide-based outside layer, which is electrochemically active for the oxidation of oxygen ions into molecular oxygen, said method comprising keeping the anode dimensionally stable during electrolysis by maintaining a sufficient concentration of iron species and dissolved alumina in the electrolyte, and operating the cell at a sufficiently low temperature so that the required concentration of iron species in the electrolyte is limited by the reduced solubility of iron species in the electrolyte at the operating temperature, which consequently limits the contamination of the product aluminium by iron to an acceptable level.

58. The method of claim 57, wherein the cell is operated at an electrolyte temperature above 700° C.

59. The method of claim 58, wherein the operating temperature ranges from between 820° C. and 870° C.

60. The method of claim 57, wherein the cell is operated with an electrolyte containing NaF and $AlF_3$ in weight ratio $NaF/AlF_3$ from 0.7 to 0.85.

61. The method of claim 57, wherein the amount of dissolved alumina contained in the electrolyte is maintained is below 8 weight %.

62. The method of claim 61, wherein the concentration of alumina is between 2 and 6 weight %.

63. The method of claim 57, wherein the amount of dissolved iron preventing dissolution of the iron oxide-based anode layer is such that the product aluminium is contaminated by no more than 2000 ppm iron.

64. The method of claim 63, wherein the contamination is no more than 1000 ppm iron.

65. The method of claim 64, wherein the contamination is no more than 500 ppm iron.

66. The method of claim 57, wherein iron species are intermittently or continuously fed into the electrolyte to maintain the amount of iron species in the electrolyte which prevents at the operating temperature the dissolution of the anode iron oxide-based layer.

67. The method of claim 66, wherein the iron species are fed in the form of iron metal and/or an iron compound.

68. The method of claim 67, wherein the iron species are fed into the electrolyte in the form of iron oxide, iron fluoride, iron oxyfluoride and/or an iron-aluminium alloy.

69. The method of claim 68, wherein the iron species are periodically fed into the electrolyte together with alumina.

70. The method of claim 66, wherein a sacrificial electrode continuously feeds the iron species into the electrolyte.

71. The method of claim 70, comprising applying a voltage which is lower than the voltage of oxidation of oxygen $O^-$ and supplying an electric current to the sacrificial electrode to control and/or promote the dissolution of the sacrificial electrode into the electrolyte.

72. The method of claim 71, comprising adjusting the electric current supplied to the sacrificial electrode so that it corresponds to a current necessary for the dissolution of the required amount of iron species into the electrolyte replacing the iron which is cathodically reduced and not otherwise compensated.

73. The method of claim 57, for producing aluminium on an aluminium-wettable cathode.

74. The method of claim 73, wherein the produced aluminium continuously drains from said aluminium-wettable cathode.

75. The method of claim 57, for producing aluminium in a bipolar cell comprising passing an electric current from the surface of the terminal cathode to the surface of the terminal anode as ionic current in the electrolyte and as electronic current through the bipolar electrodes, thereby electrolysing the alumina dissolved in the electrolyte to produce aluminium on each cathode surface and oxygen on each anode surface.

76. The method of claim 57, comprising circulating the electrolyte between the anodes and facing cathodes thereby improving dissolution of alumina into the electrolyte and/or improving the supply of dissolved alumina under the active surfaces of the anodes.

77. The method of claim 57, wherein the oxide-based layer is a hematite-based layer.

78. A cell component which can be maintained dimensionally stable in a cell for the electrowinning of aluminum according to claim 1, having an iron oxide-based outside layer, which is electrochemically active for the oxidation of oxygen ions into molecular oxygen.

79. The cell component of claim 78, wherein the hematite-based layer covers a metal-based substrate comprising at least one metal, an alloy, an intermetallic compound or a cermet.

80. The cell component of claim 78, wherein the oxide-based layer is a hematite-based layer.

81. The cell of claim 1, wherein the oxide-based layer is a hematite-based layer.

82. A cell for the electrowinning of aluminium by the electrolysis of alumina dissolved in a molten fluoride-containing electrolyte, comprising one or more anodes, each having a metal-based substrate and an electrochemically-active transition metal oxide-based outside layer which remains dimensionally stable by maintaining in the electrolyte a concentration of dissolved alumina and transition metal species which are present as one or more corresponding transition metal oxides in the electrochemically-active layer, the cell operating temperature being sufficiently low so that the required concentration of transition metal species in the electrolyte is limited by the reduced solubility thereof in the electrolyte at the operating temperature, which consequently limits the contamination of the product aluminium to an acceptable level by the transition metal(s) present as one or more corresponding transition metal oxides in the electrochemically-active layer.

83. The cell of claim 82, wherein the electrochemically-active layer is made of an oxidised nickel-cobalt alloy which remains dimensionally stable by maintaining in the electrolyte a concentration of nickel and/or cobalt species.

84. The cell of claim 83, wherein the cobalt nickel atomic ratio is in the range of 2 to 2.7.

85. A method of producing aluminium in a cell according to claim 82, comprising an anode having a metal-based anode substrate and an electrochemically-active transition metal oxide-based outside layer, said method comprising keeping the anode dimensionally stable during electrolysis by maintaining a concentration of dissolved alumina and transition metal species which are present as one or more corresponding transition metal oxides in the electrochemically-active layer, and operating the cell at a sufficiently low temperature so that the required concentration of transition metal species in the electrolyte is limited by the reduced solubility thereof in the electrolyte at the operating temperature, which consequently limits the contamination of the product aluminium to an acceptable level by the transition metal(s) present as one or more corresponding transition metal oxides in the electrochemically-active layer.

* * * * *